US008640660B2

(12) United States Patent
Frickmann

(10) Patent No.: US 8,640,660 B2
(45) Date of Patent: Feb. 4, 2014

(54) CONTINUOUSLY VARIABLE VALVE ACTUATION APPARATUS FOR AN INTERNAL COMBUSTION ENGINE

(75) Inventor: Jesper Frickmann, Raleigh, NC (US)

(73) Assignee: Jesper Frickmann, Raleigh, NC (US)

( * ) Notice: Subject to any disclaimer, the term of this patent is extended or adjusted under 35 U.S.C. 154(b) by 249 days.

(21) Appl. No.: 13/045,510

(22) Filed: Mar. 10, 2011

(65) Prior Publication Data

US 2012/0227694 A1 Sep. 13, 2012

(51) Int. Cl.
*F01L 1/34* (2006.01)

(52) U.S. Cl.
USPC ..... 123/90.16; 123/90.15; 123/90.24

(58) Field of Classification Search
USPC ..... 123/90.16
See application file for complete search history.

(56) References Cited

U.S. PATENT DOCUMENTS

| | | | | |
|---|---|---|---|---|
| 4,572,118 | A * | 2/1986 | Baguena | 123/90.16 |
| 4,583,501 | A * | 4/1986 | Williams | 123/90.15 |
| 5,732,669 | A * | 3/1998 | Fischer et al. | 123/90.16 |
| 5,937,809 | A * | 8/1999 | Pierik et al. | 123/90.16 |
| 6,029,618 | A | 2/2000 | Hara et al. | |
| 6,267,090 | B1 * | 7/2001 | Schneider | 123/90.39 |
| 6,382,151 | B2 * | 5/2002 | Pierik | 123/90.16 |
| 6,382,152 | B2 * | 5/2002 | Pierik | 123/90.16 |
| 6,390,041 | B2 | 5/2002 | Nakamura et al. | |
| 6,401,677 | B1 * | 6/2002 | Rohe et al. | 123/90.16 |
| 6,425,357 | B2 | 7/2002 | Shimizu et al. | |
| 6,684,832 | B1 * | 2/2004 | Codina et al. | 123/90.16 |
| 6,820,579 | B2 | 11/2004 | Kawamura et al. | |
| 6,823,826 | B1 | 11/2004 | Sugiura et al. | |
| 6,907,852 | B2 | 6/2005 | Schleusener et al. | |
| 6,968,819 | B2 | 11/2005 | Fujii et al. | |
| 7,299,775 | B2 | 11/2007 | Tateno et al. | |
| 7,434,553 | B2 | 10/2008 | Nakano | |
| 2001/0037781 | A1 * | 11/2001 | Fischer et al. | 123/90.24 |
| 2003/0111031 | A1 * | 6/2003 | Hendricksma et al. | 123/90.15 |
| 2003/0154940 | A1 * | 8/2003 | Pierik | 123/90.16 |
| 2007/0101957 | A1 * | 5/2007 | Shui | 123/90.16 |
| 2007/0163523 | A1 | 7/2007 | Miyazato et al. | |
| 2009/0159026 | A1 * | 6/2009 | Yamada et al. | 123/90.15 |

* cited by examiner

*Primary Examiner* — Kenneth Bomberg
*Assistant Examiner* — Daniel Wagnitz

(57) ABSTRACT

The apparatus includes a driving shaft with a first gear wheel, a frame able to rotate within limits about the driving shaft, a servo mechanism for controlling the angular position of the frame, a valve-lifting crankshaft with a second gear wheel supported by the frame, a rocker cam assembly, a connecting rod pivotally connected to the valve-lifting crankshaft and the rocker cam assembly, a cam follower operatively connected to a charge exchange valve, and a spring for urging the cam follower against a cam lobe. The engine rotates the driving shaft. The first gear wheel rotates the second gearwheel and the valve-lifting crankshaft. The connecting rod transmits motion from the valve-lifting crankshaft to the rocker cam assembly. Stroke, lifting duration, and phase can be controlled by the angular position of the frame.

18 Claims, 13 Drawing Sheets

CONTINUOUSLY VARIABLE VALVE ACTUATION APPARATUS FOR AN INTERNAL COMBUSTION ENGINE

BACKGROUND OF THE INVENTION

The present invention relates to a continuously variable valve actuation apparatus in an internal combustion engine which has charge exchange valves. The apparatus is able to continuously vary stroke, lifting duration, and phase.

Continuously variable valve actuation systems are known in the art, and disclosures of mechanical, hydraulic, and electromagnetic systems are known. The advantages of such systems are numerous. Most importantly, such systems can control the charge filling of a four-cycle spark ignition engine without the conventional throttle valve, thus reducing the pumping loss and improving the efficiency. Another advantage is the ability to generate valve lift curves that suit a wide range of operating conditions. The following discussion of prior art will focus on mechanical systems that presently appear to be relevant for the invention being disclosed here.

A first type of apparatus is disclosed by U.S. Pat. No. 6,029,618 (Nara et al.) This apparatus consists of an eccentric crank and a rocking cam placed coaxially on a driveshaft, and operatively connected by a link mechanism that can vary stroke and lifting duration of the valves. U.S. Pat. No. 6,390,041 (Nakamura et al.) points out that this system is sensitive to dimensional errors of the components when it operates in the region of low lift. This incurs higher requirements for machining accuracy and hence higher production cost. The latter patent discloses a microcomputer-based controller to help compensate for the problem, but it does not solve the fundamental mechanical issue.

A second type of apparatus is disclosed by U.S. Pat. No. 6,425,357 (Shimizu et al.) This apparatus consists of a rocker assembly inserted between a camshaft and a follower connected to a valve of the engine. The rocker assembly includes an input portion driven by the cam, and an output portion contacting the follower. By varying the angle between the input and output portions with a sliding gear, stroke and lifting duration can be varied. U.S. Pat. No. 6,823,826 (Sugiura et al.) points out that the sliding gear is difficult and expensive to manufacture, as it is difficult to machine the inner parts of the helical splines for the sliding gear, and as it must be machined with high accuracy, in order to avoid a situation where only a small fraction of the teeth carry the entire load. The solution devised by this patent is to replace the sliding gear with a single pin, contacting a diagonal hole or a diagonal surface. This will, however, shift the entire load of the sliding gear to a single point of contact. US Pat. Application Pub. No. 2007/0163523 (Miyazato et al.) points out another problem with this type of apparatus. If the engine block is manufactured from an aluminum alloy, and the control shaft for moving the sliding gear is manufactured from steel, then the different temperature expansion coefficients of these materials will cause a difference between the adjustment among the cylinders in the engine block. This hinders accurate control of valve lift. The devised solution is to manufacture the engaging parts of the control shaft (the sliding gear) from steel, and the parts in between from an aluminum alloy. This solution will add to the manufacturing cost and complexity of the system as well. Finally, this type of apparatus is adding to the total spring load supported inertia of the valve train, thus limiting the maximum operation speed and increasing friction due to the requirement for higher spring loads.

A third type of apparatus is disclosed by U.S. Pat. No. 6,907,852 (Schleusener et al.) This apparatus consists of a spring loaded pivoting lever, the top end having a roller contacting a control path and an eccentric control shaft which controls the position where the roller contacts the path. The camshaft presses against another roller in the middle of the lever to rock it sideward. At the other end of the lever, a ramp contacts a follower connected to the valve. The eccentric control shaft is rotated by an electric stepper motor, varying stroke and lifting duration. This type of apparatus is also adding to the total spring load supported inertia of the valve train, thus limiting the maximum operation speed and increasing friction due to the requirement for higher spring loads. Moreover, the requirement for space in the engine head is high.

Common for all three types of apparatuses above is the requirement for a separate additional device to vary the phase. This adds to the total cost and complexity of embodiments, and introduces the extra complication of synchronizing the two systems, especially during transient states. In the worst case, poor synchronization can cause a valve to collide with a piston top, resulting in major damage to the engine. U.S. Pat. No. 6,820,579 (Kawamura et al.) discloses an electronic control system for synchronizing the two systems, exemplified by the first type of apparatus above. This system accounts for the rate constants of change for the respective systems during transient states. U.S. Pat. No. 7,434,553 (Nakano) discloses a combined hydraulic circuit for controlling the two systems in the case of the second type of apparatus above. These extra control systems also add to the cost and complexity of embodiments.

Examples of apparatuses which can vary valve stroke, lifting duration, and phase simultaneously are disclosed in U.S. Pat. No. 6,968,819 (Fujii et al.) and U.S. Pat. No. 7,299,775 (Tateno et al.). Common properties for these inventions are that they add to the spring load supported inertia of the valve train, and that they are relatively complicated mechanisms. Presently, no apparatus which can vary stroke, lifting duration, and phase simultaneously is known to be in mass production.

SUMMARY OF THE INVENTION

Therefore, some objects of the present invention are to provide a continuously variable valve actuation apparatus, which is relatively simple and robust, which is not very sensitive to temperature change and dimensional errors of the manufactured parts, which has low friction to benefit fuel economy, and which can vary stroke, lifting duration, and phase simultaneously without requiring a separate valve phasing device. Further objects are that the spring load supported parts of the valve train do not have more inertia than the corresponding parts for a traditional overhead camshaft mechanism, and that the fully supported parts have low inertia as well.

The present invention provides a continuously variable valve actuation apparatus, comprising:

- a driving shaft that is rotated by the engine,
- a first gear wheel attached to the driving shaft,
- a frame pivotally supported such that it can rotate within a predetermined angular interval about the driving shaft,
- a servo mechanism, or similar means, for controlling the angular position of the frame,
- a valve-lifting crankshaft supported by the frame,
- a second gear wheel attached to the valve-lifting crankshaft and engaged with the first gearwheel,
- a rocker cam assembly, a cam lobe of the rocker cam assembly, a connecting rod pivotally connected to the valve-lifting crankshaft and the rocker cam assembly, a cam follower contacting the cam lobe and operatively connected to a charge exchange valve, a valve spring, or similar means, for urging the cam follower against the cam lobe.

The driving shaft and the first gear wheel drives the second gear wheel and the valve-lifting crankshaft. The connecting rod transmits motion from the valve-lifting crankshaft to the rocker cam assembly. The rocker cam assembly actuates the cam follower and the valve. Stroke, lifting duration, and phase can be controlled by the angular position of the frame.

BRIEF DESCRIPTION OF THE DRAWINGS

The above and further objects, features and advantages of the present invention will become understood from the following description with reference to the accompanying drawings, in which like reference numerals and characters are used to represent like or similar elements.

DETAILED DESCRIPTION OF A FIRST EMBODIMENT

Figure 1:
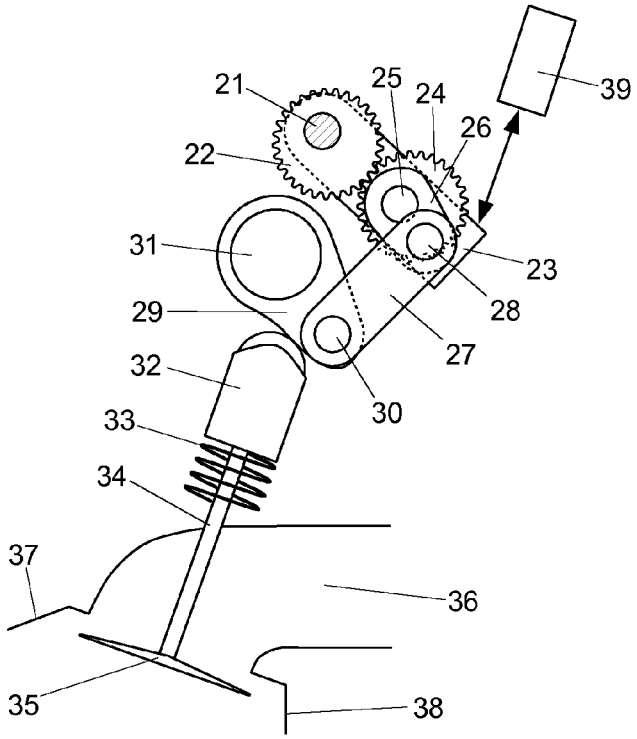
FIG. 1 is a side view of a first exemplary embodiment.

A first exemplary embodiment is shown on FIG. 1. This embodiment actuates a poppet type intake valve 35 of an internal combustion engine having an engine head (not shown). A driving shaft 21 is rotating in clockwise direction and is driven by the engine over a timing belt (not shown). The driving shaft is supported by the engine head. A first gear wheel 22 is attached to driving shaft 21. A frame 23 is pivotally supported such that it can rotate within a predetermined angular interval about driving shaft 21. The angular position of frame 23 is controlled by a servo mechanism 39 and control linkage (not shown). A second gear wheel 24 is attached to a valve-lifting crankshaft 25 providing a crank arm 26. Valve-lifting crankshaft 25 is supported by frame 23. Second gear wheel 24 is engaged with first gear wheel 22, and is therefore rotating in counterclockwise direction. A connecting rod 27 is pivotally connected to crank arm 26 by a first joiner pin 28, and to a rocker cam assembly 29 by a second joiner pin 30. Connecting rod 27 hence transmits motion from valve-lifting crankshaft 25 to rocker cam assembly 29. Rocker cam assembly 29 has a fulcrum 31, which is supported by the engine head. A cam follower 32 is urged against a lobe of rocker cam assembly 29 by a valve spring 33. Cam follower 32 is a tappet with roller. A valve stem 34 is attached to cam follower 32 and to poppet valve 35. Part of an intake manifold 36, a cylinder top 37 and a cylinder wall 38 are also shown on the drawing.

Gear wheels 22 and 24 of the first embodiment are elliptical and rotate about an elliptical focus. This is an example of an optimized gear wheel geometry. Some advantages of gear wheels with optimized geometries will be discussed later.

Figure 2:
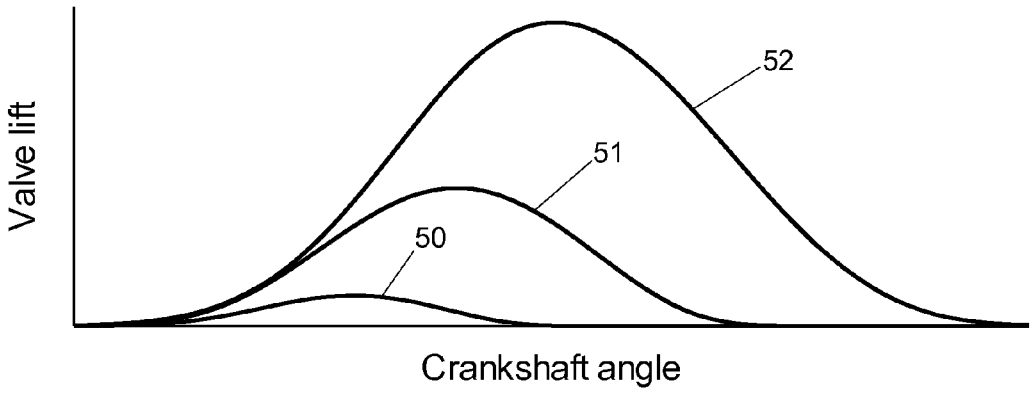
FIG. 2 shows valve lift curves that can be generated by the first embodiment.

FIG. 2 shows three valve lift curves: a curve with small stroke 50, a curve with intermediate stroke 51, and a curve with maximum stroke 52. These three lift curves are sampled from the continuous spectrum of lift curves that can be generated by the first embodiment. It is also possible to reduce the stroke to zero. Stroke and lifting duration are coupled with phasing, such that timing of valve opening is approximately constant, and timing of valve closing is retarded, as stroke and lifting duration are increased. This can be advantageous for intake valves in spark ignition engines, where stroke and lifting duration are varied to control the charge filling instead of using a throttle valve, as this coupling of stroke and lifting duration with phasing will give low pumping loss, and hence good fuel economy, for the engine.

Figure 3A:
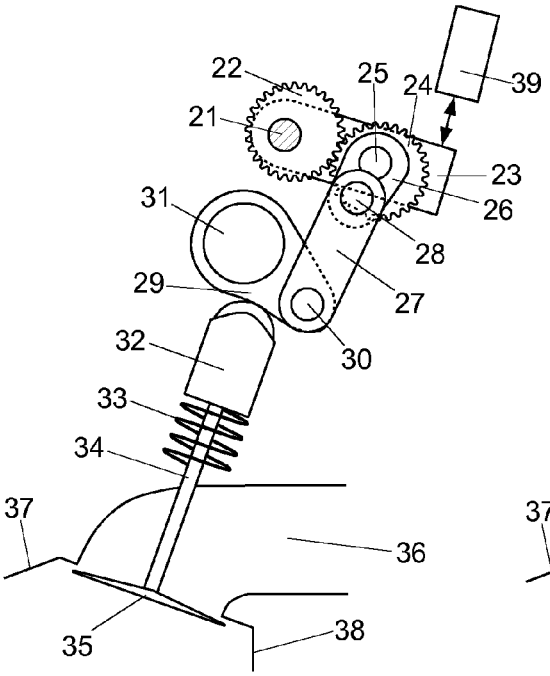
FIG. 3A-D show side views of the first embodiment at four different positions.
Figure 3B:
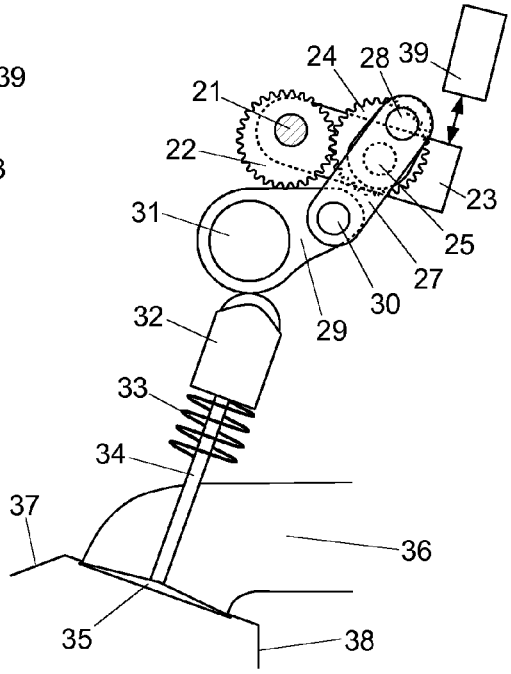
Figure 3C:
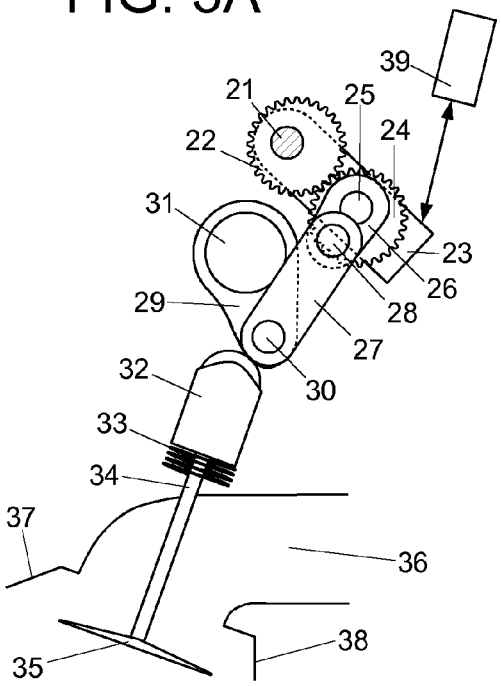
Figure 3D:
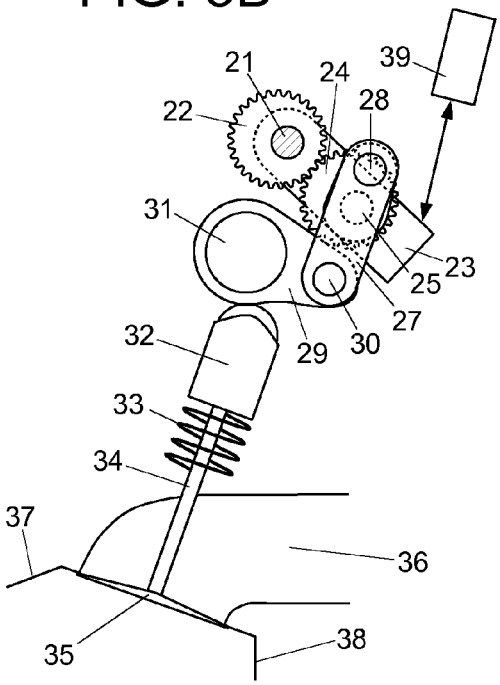

In order to see how the angular position of frame 23 controls stroke and lifting duration, attention is directed to FIG. 3A-D. FIGS. 3A and 3B show the first embodiment having frame 23 rotated counterclockwise, in order to generate a lift curve with small stroke and lifting duration. FIGS. 3C and 3D show the embodiment having frame 23 rotated to the most clockwise position, in order to generate a lift curve with maximum stroke and lifting duration. FIGS. 3A and 3C show angular positions of driving shaft 21 where maximum valve lift is obtained. FIGS. 3B and 3D show angular positions of driving shaft 21 where maximum backswing of rocker cam assembly 29 is obtained; i.e. rocker cam assembly 29 is rotated to the most counterclockwise position away from cam follower 32.

Figure 4A:
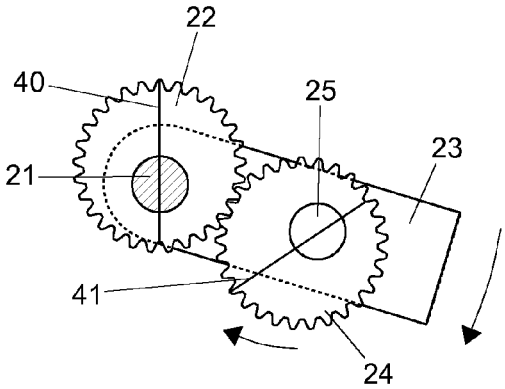
FIG. 4A-B is a side view of a frame and a first and second gear wheel of the first embodiment.
Figure 4B:
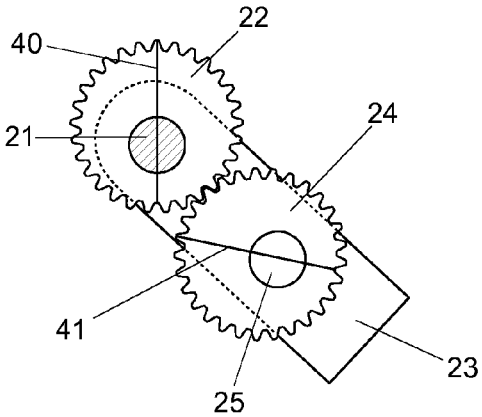

In order to see how the angular position of frame 23 also controls phasing, attention is directed to FIG. 4A-B. Here it is shown how the phase of second gear wheel 24 is affected by the angular position of frame 23. An elliptical main axis 40 of first gear wheel 22, and an elliptical main axis 41 of second gear wheel 24 are shown, in order to indicate the angular positions of the respective gear wheels more clearly. First gear wheel 22 remains at the same angular position on both figures, and frame 23 is rotated clockwise on FIG. 4B relative to FIG. 4A. Therefore, the angular position of second gear-wheel 24 is biased in clockwise direction on FIG. 4B relative to FIG. 4A. Since second gear wheel 24 is rotating counter-clockwise during operation, the phase is retarded. Hence, when frame 23 is rotated clockwise, and stroke and lifting duration are increased, the phase is retarded for the first embodiment.

Figure 5:
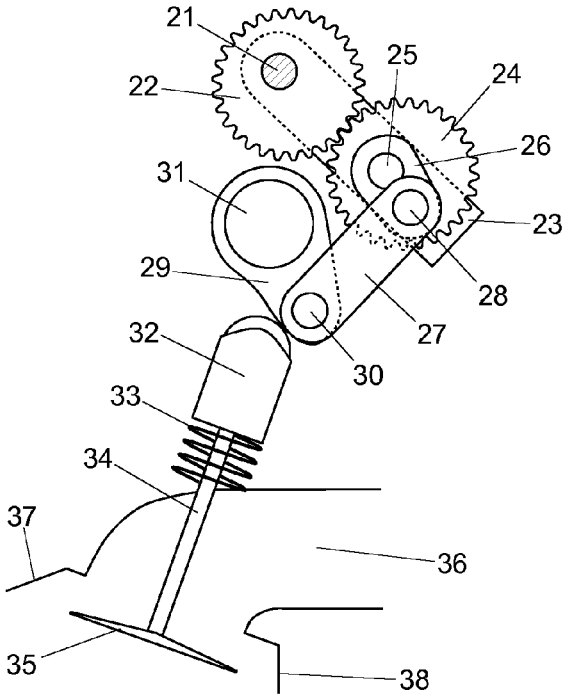
FIG. 5 is a side view of a second embodiment.
Figure 6:
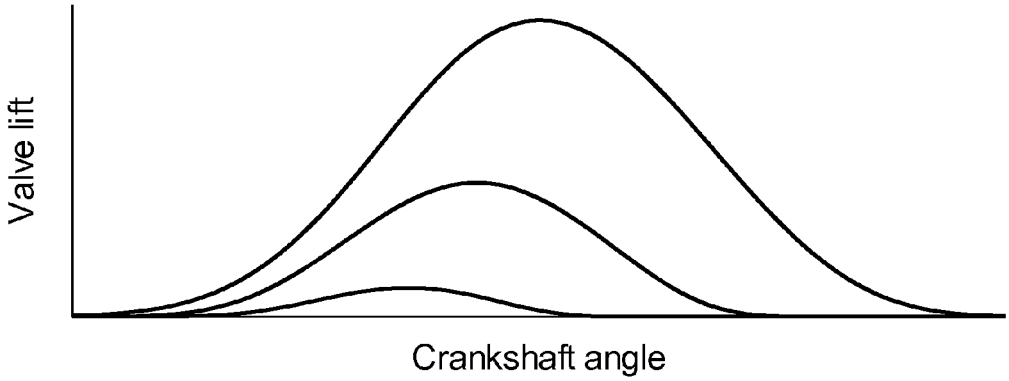
FIG. 6 shows valve lift curves that can be generated by the second embodiment.
Figure 7:
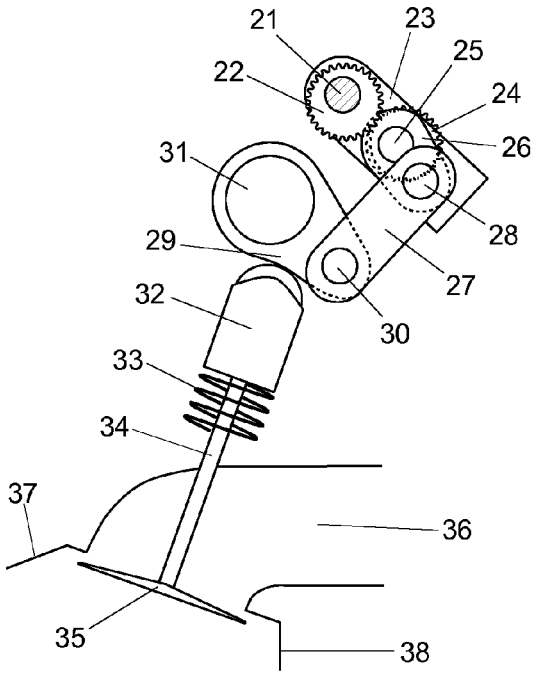
FIG. 7 is a side view of a third embodiment.
Figure 8:
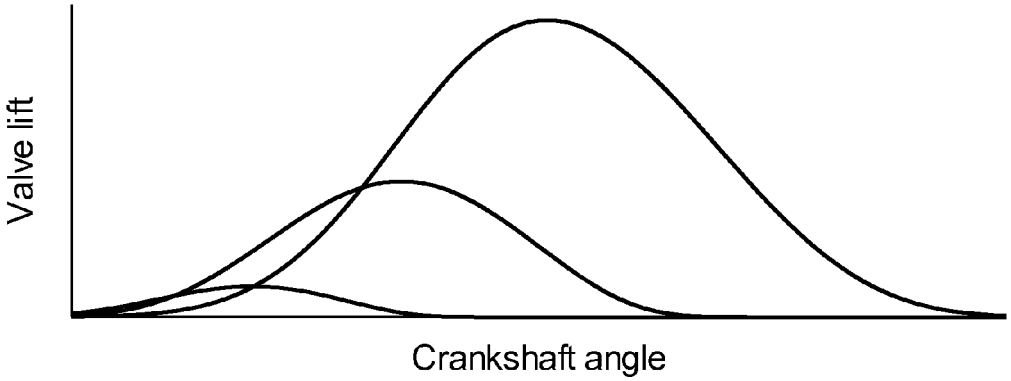
FIG. 8 shows valve lift curves that can be generated by the third embodiment.

The amount of phase change relative to the change of stroke and lifting duration is determined mainly by the sizes of the gear wheels relative to the length of crank arm 26. FIG. 5 shows a second embodiment, where the sizes of the gear wheels are increased relative to the first embodiment. The second embodiment can generate lift curves as shown on FIG. 6. It is seen that phase change relative to stroke and lifting duration change is reduced for the second embodiment, as compared to the first embodiment. FIG. 7 shows a third embodiment, where the sizes of the gear wheels are reduced relative to the first embodiment. The third embodiment can generate lift curves as shown on FIG. 8. It is seen that phase change relative to stroke and lifting duration change is increased for the third embodiment, as compared to the first embodiment.

Description of an Embodiment for Actuating Exhaust Valves

Figure 9:
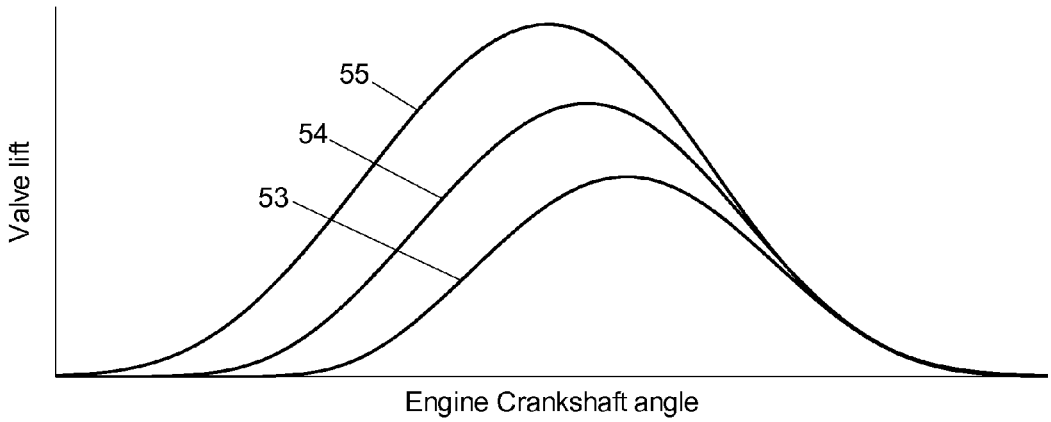
FIG. 9 shows valve lift curves that can be generated by a fourth embodiment for exhaust valves.

A fourth embodiment for actuating exhaust valves will be described subsequently. If a four stroke piston engine is running with partial charge filling, then there may be a vacuum when the piston reaches the bottom position after a power stroke. It may therefore be desirable to retard the timing of exhaust valve opening until the point during the exhaust stroke where neutral pressure in the combustion chamber is reached. If the rotational directions of the gear wheels are reversed, as compared to the first embodiment, such that first gear wheel 22 is rotating counterclockwise and second gear wheel 24 is rotating clockwise, then the lift curves of the first embodiment will be "played backward". Hence, the timing of valve closing will be approximately constant, and the timing of valve opening will be advanced as stroke and lifting duration are increased. Three lift curves generated by such a fourth embodiment are shown on FIG. 9. A lift curve with small stroke and retarded valve opening 53, an intermediate lift curve 54, and a lift curve with maximum stroke 55 are shown.

Description of Optimized Gear Wheel Geometries

Gear wheels with optimized geometries, such as e.g. the elliptical geometry chosen for the previous embodiments, can have some advantages over circular gear wheels as will be discussed in the following.

Figure 10:
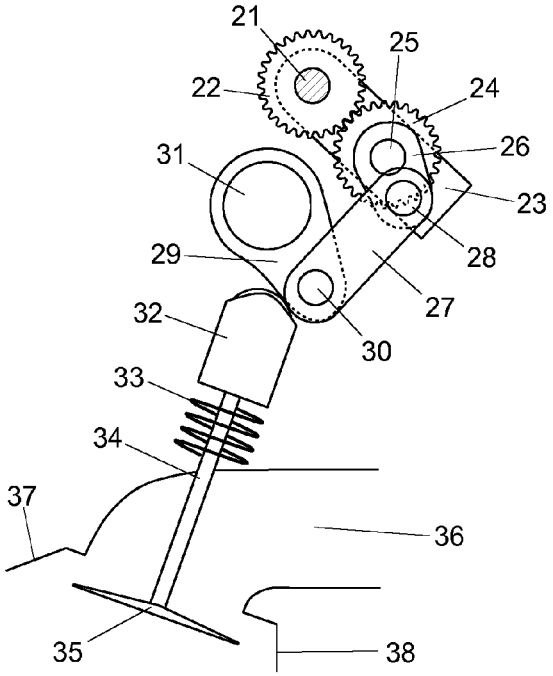
FIG. 10 is a side view of a fifth embodiment.
Figure 11:
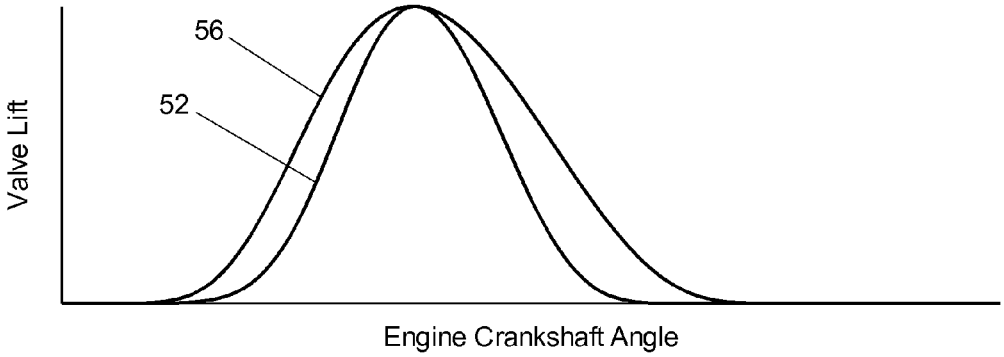
FIG. 11 shows a lift curve of the first embodiment and a lift curve of the fifth embodiment for comparison.

A fifth embodiment, shown on FIG. 10, provides circular instead of elliptical gear wheels. FIG. 11 shows lift curve 52 for the first embodiment, and a lift curve 56 for the fifth embodiment. The following differences between the lift curves can be observed:

- The lifting duration is longer for the fifth embodiment than for the first embodiment.
- The lift curve for the fifth embodiment is more asymmetric than the lift curve for the first embodiment. For the fifth embodiment the valve opening is steeper and the valve closing is less steep.

Therefore, some additional changes are required for the fifth embodiment, if lift curves similar to the desirable lift curves generated by the first embodiment are to be obtained. In the following it will be discussed how these changes can be made, and what disadvantages these changes will incur, as compared to the first embodiment with optimized gear wheel geometry.

The lifting duration of the first embodiment is shorter than the lifting duration of the fifth embodiment, because for the first embodiment, the angular velocity of second gear wheel 24 and valve-lifting crankshaft 25 is higher when the valve is open than when the valve is closed, due to the gear wheel geometry.

Figure 12:
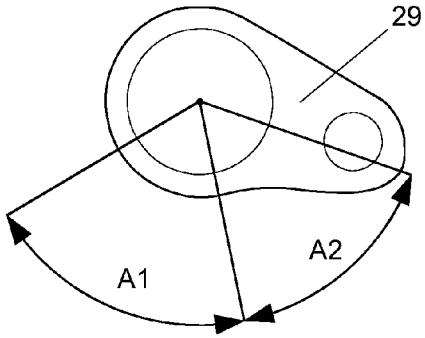
FIG. 12 is a side view of a rocker cam assembly of the first embodiment, where a first and a second angular portion of a cam lobe are indicated.

FIG. 12 shows a cam lobe of rocker cam assembly 29, divided into a first angular portion A1 which is nearly circular, and a second angular portion A2 which provides a ramp profile. The valve lift is zero when the cam the follower is contacting first angular portion A1. The valve is lifted when the cam follower is contacting second angular portion A2. If the lifting duration of the fifth embodiment is to be reduced to the same lifting duration as for the first embodiment, then second angular portion A2 can be reduced in size relative to first angular portion A1. This can be accomplished in the following ways (or combinations thereof):

- Second angular portion A2 can be made smaller. This will make the ramp slope more steep and has the undesirable consequence that sideward force on the cam follower is increased.
- First angular portion A1 can be enlarged by increasing the back swing of rocker cam assembly 29, and hence the total angular interval of the rocker cam assembly motion. There is, however, a limit to how much the back swing can be increased before the angle between the center axis of rocker cam assembly 29 and the connecting rod becomes too shallow at the extreme positions. This will incur high forces on the joining pins, and could introduce a risk of lock up due to over swing of rocker cam assembly 29.
- The diameter of rocker cam assembly 29 can be increased. This will increase the total length of the cam lobe, and hence give a less steep ramp profile. Thereby, second angular portion A2 can be made smaller without increasing the steepness of the ramp profile. Increasing the diameter of rocker cam assembly 29 will, however, also increase the inertia and space requirements of the embodiment.

So far, the issue with lifting duration has been discussed. Subsequently, the issue with asymmetry of the lift curve will be discussed.

Figure 13:
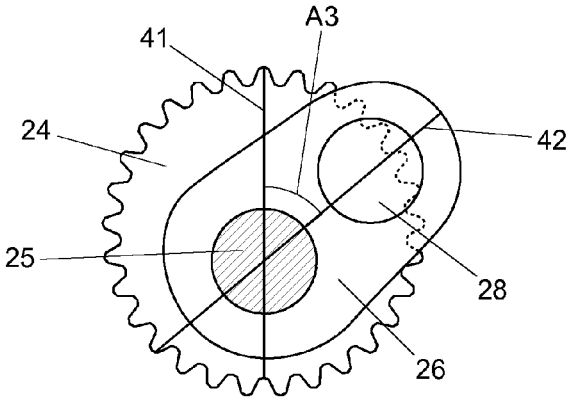
FIG. 13 is a side view of a valve-lifting crankshaft and an elliptical second gear wheel of the first embodiment.
Figure 14:
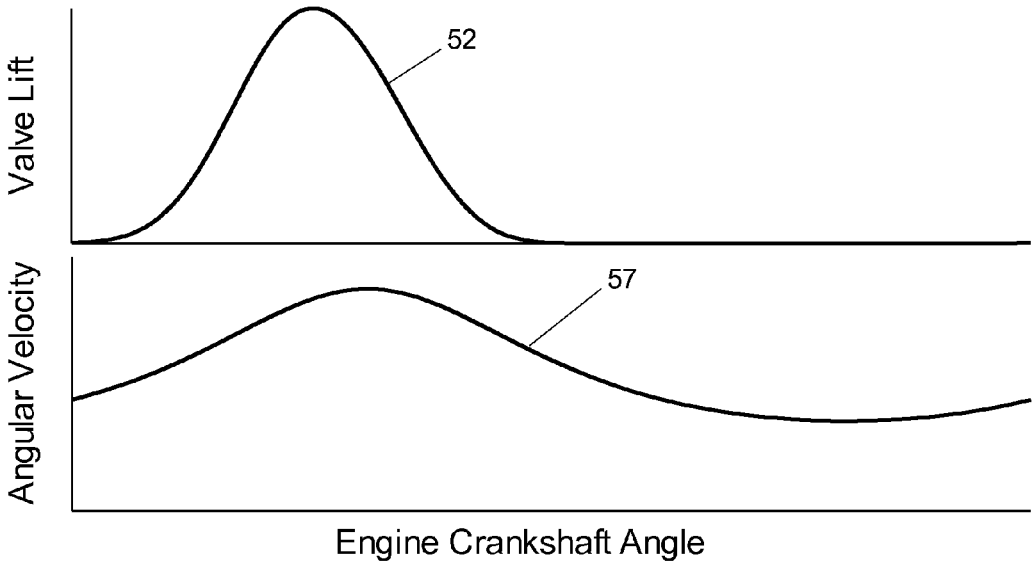
FIG. 14 shows a curve for valve lift and a curve for angular speed of a second gear wheel, both for the first embodiment.

FIG. 13 shows the geometry of second gear wheel 24 and crank arm 26 in the first embodiment. Elliptical main axis 41 of second gear wheel 24 and a center line 42 of crank arm 26 are shown. An angle A3 between elliptical main axis 41 and center line 42 is also shown. The first embodiment produces a more symmetric lift curve than the fifth embodiment, because angle A3 has been optimized. A3 is not the angle giving a maximum angular velocity of valve-lifting crankshaft 25 at the point of maximum valve lift. The maximum angular velocity is obtained at a later point, after the valve has reached maximum lift. This is shown on FIG. 14, where valve lift curve 52 is shown together with a curve 57 for the angular velocity of valve-lifting crankshaft 25. Therefore, the angular velocity of valve-lifting crankshaft 25 is higher during valve closing than during valve opening, and hence the lift curve is steeper during valve closing and less steep during valve opening than it would have been, had the point of maximum angular velocity coincided with the point of maximum valve lift. Hence, the first embodiment is able to generate more symmetric lift curves. This technique, of optimizing angle A3, is not possible for an embodiment with circular gear wheels, as the angular velocity of valve-lifting crankshaft 25 is constant. Therefore, in the case of the fifth embodiment discussed above, the lack of symmetry must be compensated for by other means, such as moving the position of driving shaft 21 and frame 23 to the right.

Figure 15:
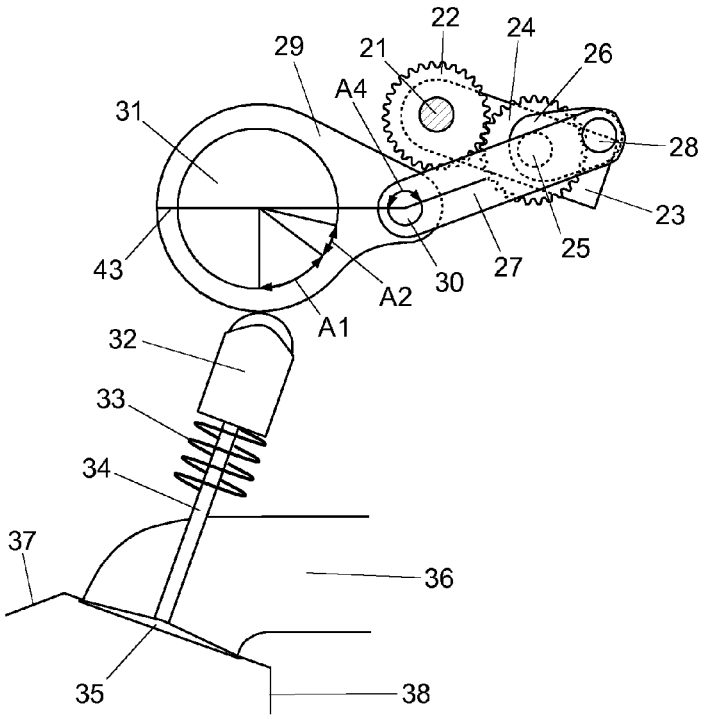
FIG. 15 is a side view of a sixth embodiment.

FIG. 15 shows a sixth embodiment where the gear wheels are circular. The above described changes have been implemented here, in order to generate lift curves more similar to the first embodiment. The diameter of the cylindrical part of rocker cam assembly 29 has been enlarged in order to increase first angular portion A1 and reduce second angular portion A2 of the cam lobe without increasing the steepness of the ramp profile. Driving shaft 21 and frame 23 have been moved to the right, in order to reduce the asymmetry of the lift curve. This has introduced the need for increasing the length of connecting rod 27. A center axis 43 of rocker cam assembly 29 is shown on the drawing. The most shallow angle A4 between center axis 43 and connecting rod 27 is 160° during the back swing of the cam. This is the position shown. For the first embodiment, the corresponding most shallow angle is only 147°. This, together with the larger rocker cam assembly with more inertia, will increase the load on joiner pins 28 and 30 for the sixth embodiment, as compared to the first embodiment. Moreover, the sixth embodiment requires more space in the engine head than the first embodiment.

The above comparison between the first and the sixth embodiments illustrates the advantages that can be gained by having gear wheels with optimized geometries, instead of ordinary circular gear wheels. Although the description above has covered the special case of elliptical gear wheel geometries, it is obvious that other gear wheel geometries are possible, and that a predetermined gear wheel geometry which is neither circular nor elliptical may be optimal for a specific embodiment. The optimal geometry for a specific embodiment can be found with numerical methods using a computer.

Description of Other Exemplary Embodiments

Figure 16A:
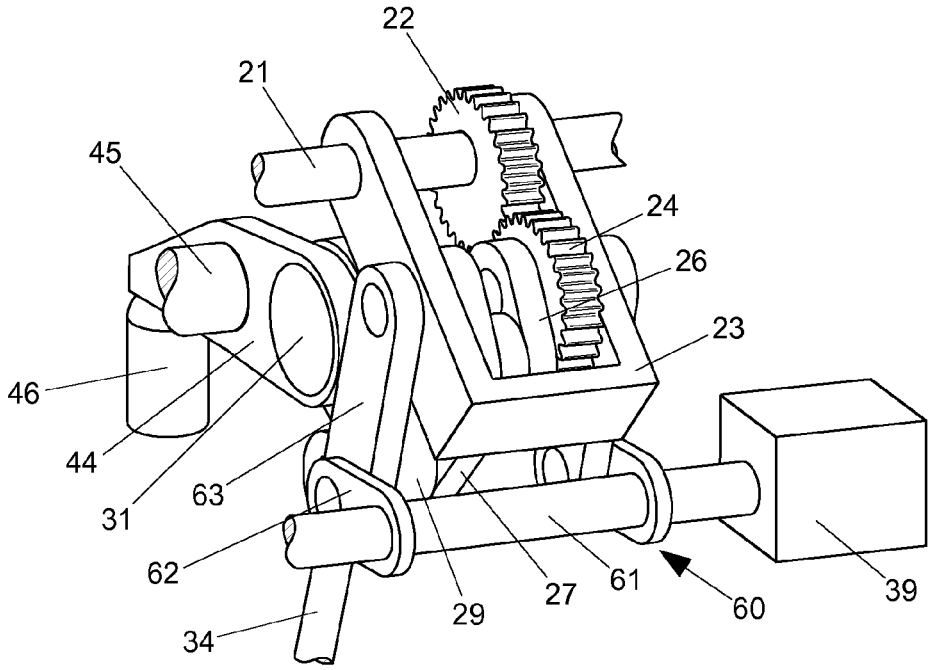
FIG. 16A-B show a perspective view of a seventh embodiment. Some elements have been omitted from FIG. 16B, in order to reveal other elements.
Figure 16B:
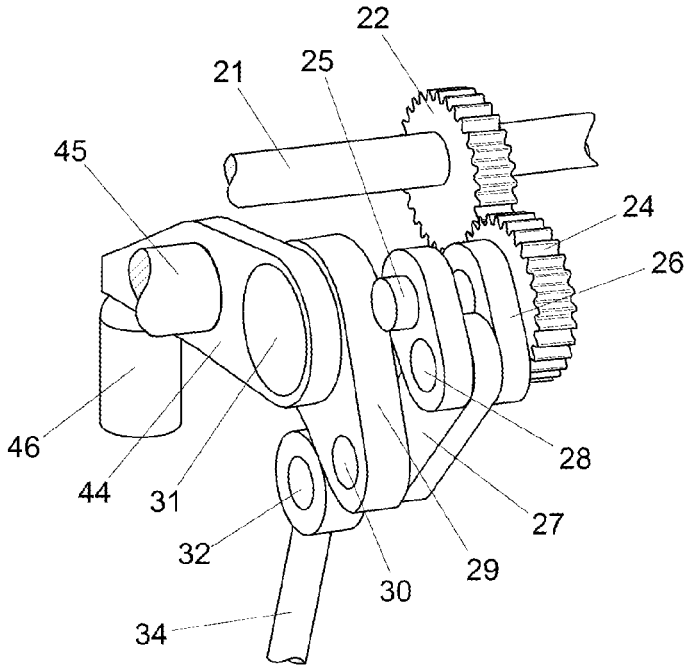

FIG. 16A shows a seventh embodiment, where valve lash adjustment is provided by a movable support for fulcrum 31 of rocker cam assembly 29. Fulcrum 31 is supported by a lever 44, and a fulcrum 45 of lever 44 is supported by the engine head. A hydraulic valve lash adjuster 46 controls the angular position of lever 44. Hence, valve lash adjustment is provided without adding inertia to the valve train. A control linkage 60 for controlling the angular position of frame 23 is also shown. A control shaft 61 is rotated by the servo mechanism 39. A control arm 62 is attached to control shaft 61, and a control rod 63 is pivotally connected to control arm 62 and frame 23. FIG. 16B shows the same view, but frame 23 and control linkage 60 have been omitted in order to reveal other parts.

Figure 17A:
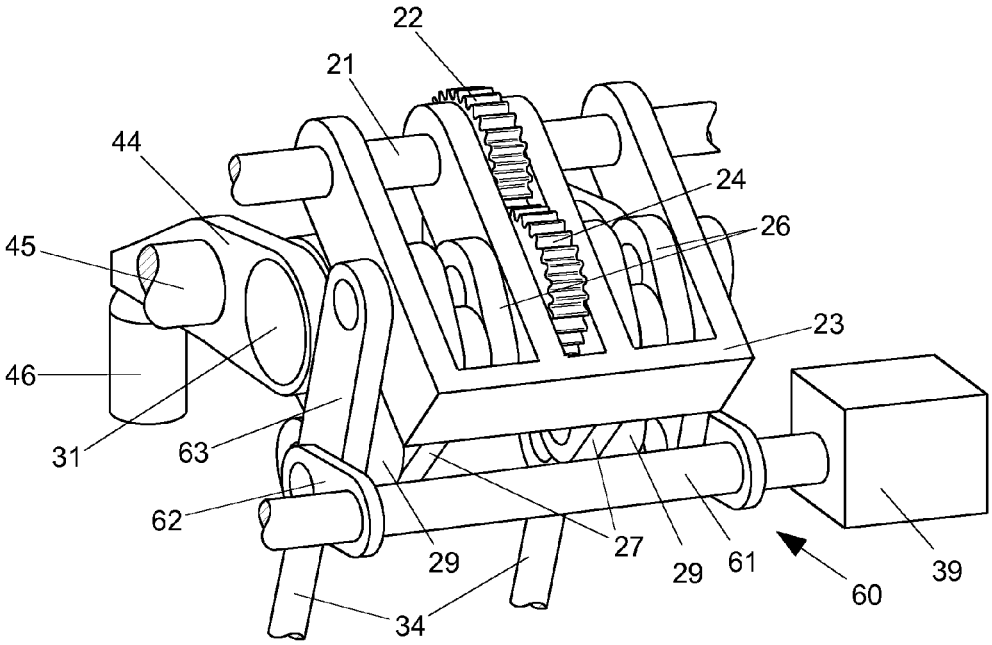
FIG. 17A-B show a perspective view of an eighth embodiment. Some elements have been omitted from FIG. 17B, in order to reveal other elements.
Figure 17B:
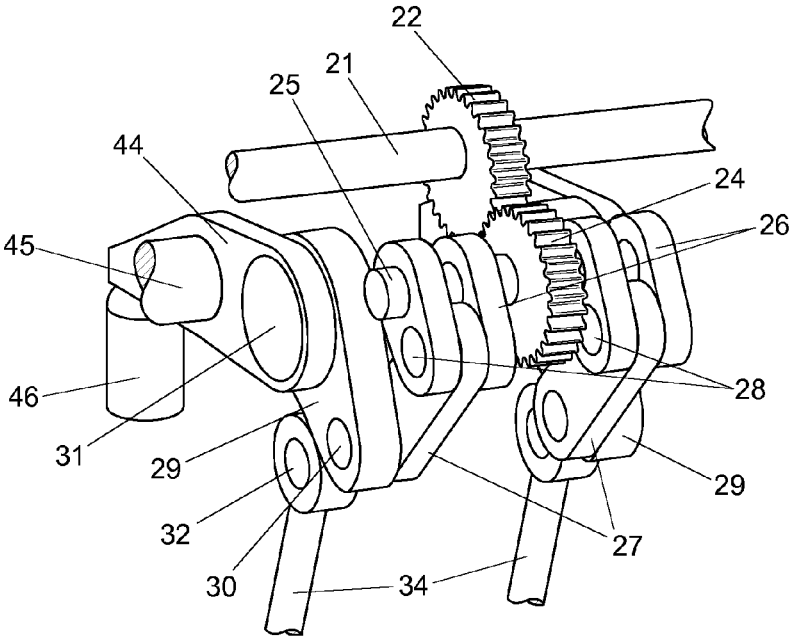

FIG. 17A shows an eighth embodiment having two crank arms 26, two connecting rods 27, and two rocker cam assemblies 29. Hence, this embodiment actuates two valves. Valve lash adjustment has been implemented the same way as for the seventh embodiment. FIG. 17B shows the same view, but frame 23 and control linkage 60 have been omitted in order to reveal other parts.

A ninth embodiment includes two separate mechanisms for actuating two intake valves of the same cylinder. Each mechanism is similar to the seventh embodiment shown on FIG. 16A. Control linkage 60 is set up such that frame 23 for the first valve is moved to a position of zero valve stroke before frame 23 for the second valve. This is accomplished by having longer control arms 62 for the first mechanism than for the second mechanism. This will increase the charge flow velocity and swirl at low charge filling, as only one valve is opened, and thus enhance turbulence and mixing during the intake stroke, improving efficiency and fuel economy of the engine at low charge filling.

Figure 18A:
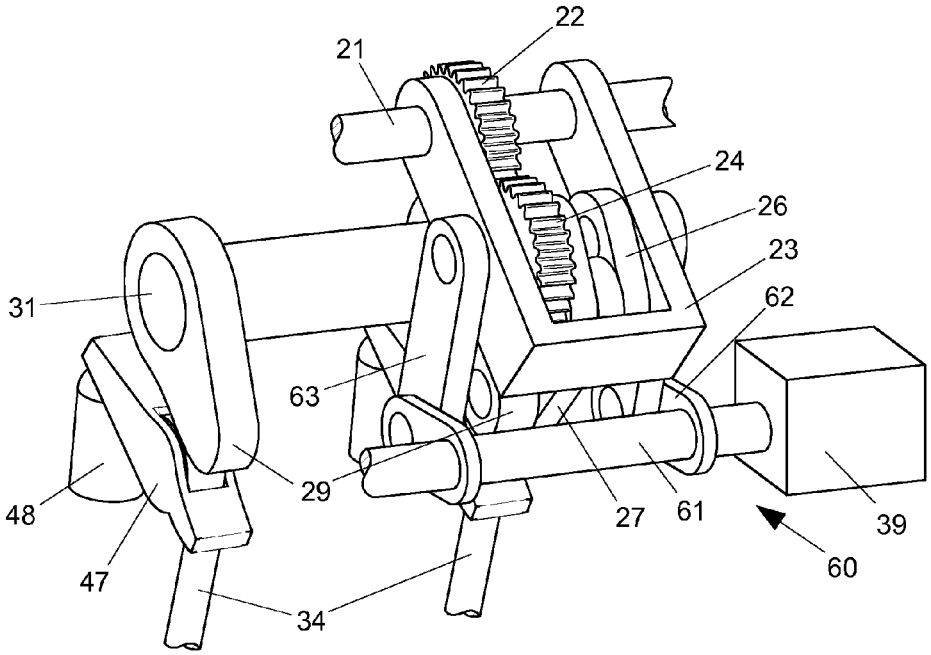
FIG. 18A-B show a perspective view of a tenth embodiment. Some elements have been omitted from FIG. 18B, in order to reveal other elements.
Figure 18B:
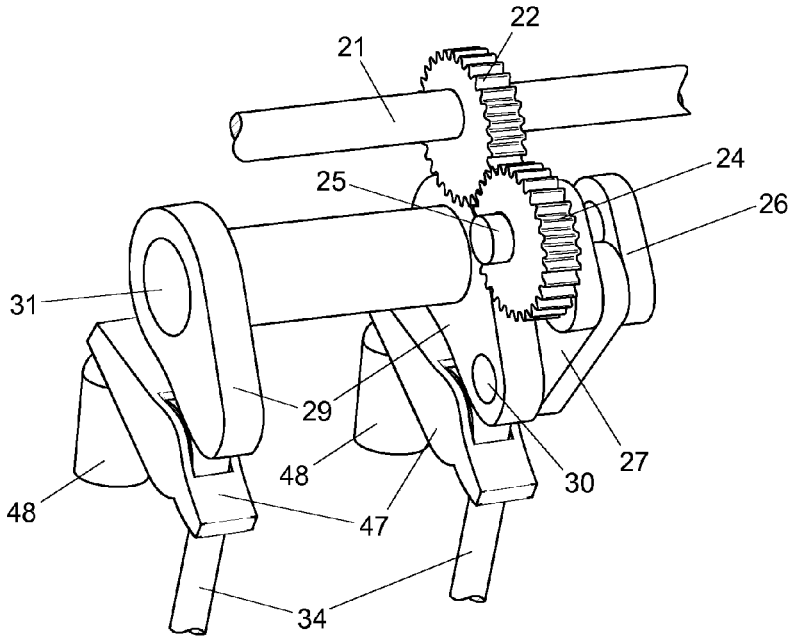

FIG. 18A shows a tenth embodiment, where rocker cam assembly 29 provides two cam lobes, each contacting a separate finger follower 47 with a roller. Hence, this embodiment actuates two valves. Valve lash adjustment is implemented with a hydraulic pivot elements 48 for each finger follower 47. FIG. 18B shows the same view, but frame 23 and control linkage 60 have been omitted in order to reveal other parts.

Figure 19:
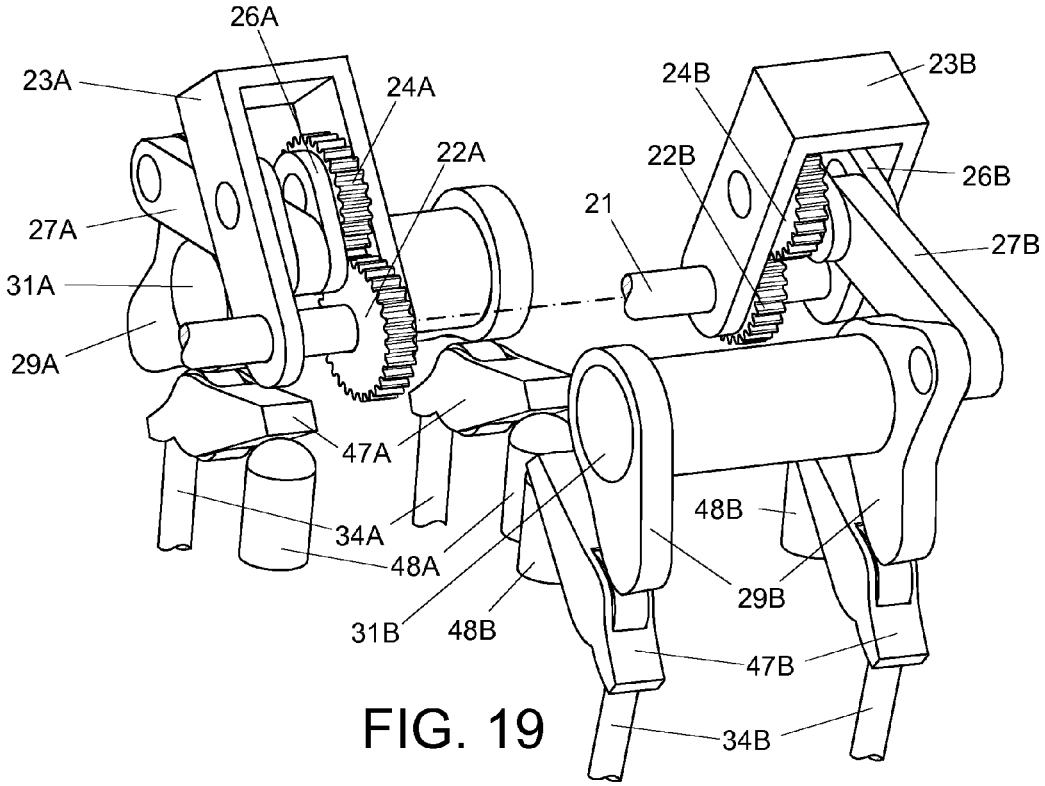
FIG. 19 is a perspective view of an eleventh embodiment.

FIG. 19 shows an eleventh embodiment. This embodiment is essentially a dual implementation of the tenth embodiment, actuating two intake and two exhaust valves. The parts specifically driving the intake valves have the letter A appended to the part numbers, and the parts specifically driving the exhaust valves have the letter B appended to the part numbers. Otherwise, parts are numbered as for the tenth embodiment. The mechanisms for actuating intake and exhaust valves, respectively, share a common driving shaft 21. Two first gear wheels 22A and 22B are attached to driving shaft 21. Connecting rods 27A and 27B are attached to rocker cam assemblies 29A and 29B at a different position than for the previous embodiments in order to allow for the position of the shared driving shaft.

While in the above exemplary embodiments, driving shaft 21 is driven over a timing belt, other means are also possible, such as e.g. gear wheels or a chain.

While frame 23 is shown as a simple construction in the above exemplary embodiments, other frame designs are possible, such as e.g. a frame spanning all the cylinders of an engine block, or a frame with reinforcements to increase its torsional stiffness. Having multiple points of support from the device controlling the angular position of frame 23 (such as e.g. control linkage 60 shown on some exemplary embodiments) can be advantageous to prevent warping of frame 23.

While one specific type of control linkage has been shown for controlling the angular position of frame 23, other arrangements are also possible, such as e.g. a rack and pinion or a spindle motor. Instead of a control linkage allowing one servo mechanism to control a plurality of valves, individual servo mechanisms each controlling a frame for one valve or cylinder are also possible. The servo mechanism can be powered by e.g. an electric motor or a hydraulic system.

Figure 20:
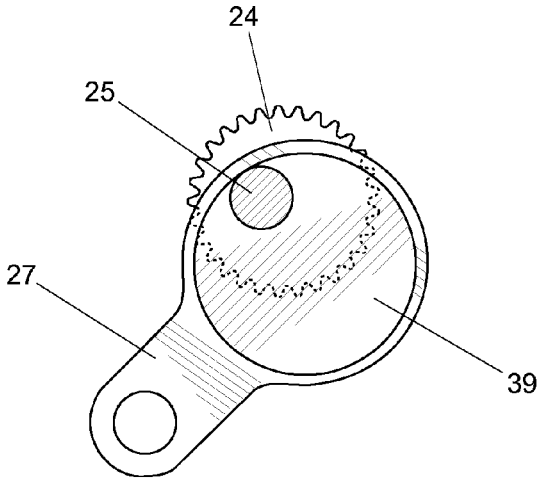
FIG. 20 is a side view of a connecting rod, and a valve-lifting crankshaft providing an eccentric.

While the above exemplary embodiments include a valve-lifting crankshaft providing a crank arm, other options such as e.g. a valve-lifting crankshaft providing an eccentric instead of a crank arm, are also possible. FIG. 20 shows an eccentric 39, attached to valve-lifting crankshaft 25 and pivotally connected to connecting rod 27.

While embodiments of rocker cam assembly 29 providing one or two cam lobes have been shown, it is also possible to have rocker cam assemblies providing three or more cam lobes.

While the means for urging the cam follower against the rocker cam assembly is a conventional steel spring in the above exemplary embodiments, other types of spring load devices, such as e.g. a pneumatic device, are also possible.

While the cam follower has been directly connected to a valve stem in the above exemplary embodiments, other types of valve trains, such as e.g. pushrods and rocker arms or hydraulic systems, are also possible.

While a specific arrangement of lever 44 has been shown in some exemplary embodiments, other arrangements for providing valve lash adjustment by means of a movable support for rocker cam assembly 29 are also possible. The arrangement chosen for a specific embodiment will depend on the specific space requirements of parts in the engine head.

While the above description of embodiments has made no mention of bearings, it is understood that pivotal joints or supports of rotating and rocking elements can be implemented with bearings of various types.

While in the description of the above exemplary embodiments, no attention has been paid to the rotational balance of parts and vibration control, it is understood that embodiments can incorporate counter weights and the like to address such issues.

The foregoing description and exemplary embodiments have been set forth merely to illustrate the invention, and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A continuously variable valve actuation apparatus for an internal combustion engine, said valve actuation apparatus comprising:

a driving shaft that is rotated by the engine, a first gear wheel attached to said driving shaft, a frame pivotally supported about said driving shaft such that said frame can rotate about said driving shaft and have an angular position within a predetermined angular interval about said driving shaft, a first means for controlling the angular position of said frame, a valve-lifting crankshaft supported by said frame, a second gear wheel attached to said valve-lifting crankshaft and engaged with said first gearwheel, a rocker cam assembly including a cam having at least one lobe, a connecting rod pivotally connected to said valve-lifting crankshaft and said rocker cam assembly, a cam follower contacting said at least one lobe, a charge exchange valve connected to said cam follower, wherein said cam follower is operable to actuate said charge exchange valve, a second means for urging said cam follower against said at least one lobe, whereby stroke, lifting duration, and phase of said charge exchange valve is controlled by the angular position of said frame.

2. The apparatus of claim 1, wherein said first means for controlling the angular position of said frame is further defined as a servo mechanism, wherein said servo mechanism comprises:

a motor operatively connected to said frame, a sensor device configured to detect the angular position of said frame, and a control device for controlling said motor in response to feedback from said sensor device.

3. The apparatus of claim 1, wherein said second means for urging said cam follower against said at least one lobe is further defined as a steel spring.

4. The apparatus of claim 1, wherein said first gear wheel defines a first elliptical shape and rotates about a first elliptical focus and said second gear wheel defines a second elliptical shape and rotates about a second elliptical focus spaced from said first elliptical focus.

5. The apparatus of claim 1, wherein said cam follower is further defined as a tappet.

6. The apparatus of claim 1, wherein said cam follower is further defined as a finger follower, said finger follower including a hydraulic pivot element for supporting said finger follower and providing valve lash adjustment.

7. The apparatus of claim 1, wherein said valve-lifting crankshaft includes an eccentric for pivotally supporting said connecting rod.

8. The apparatus of claim 1, further including:

a moveable support and a valve lash adjuster operatively connected to said moveable support, wherein said rocker cam assembly is supported by said movable support, and the position of said rocker cam assembly is adjusted by said valve lash adjuster.

9. The apparatus of claim 8, wherein said moveable support comprises a lever pivotally coupled to a fixed support and having a fulcrum defined by said fixed support wherein the angular position of said lever is adjusted by said valve lash adjuster.

10. A continuously variable valve actuation apparatus for an internal combustion engine, said valve actuation apparatus comprising:

a driving shaft that is rotated by the engine, a first gear wheel attached to said driving shaft, a frame pivotally supported about said driving shaft such that said frame can rotate about said driving shaft and have an angular position within a predetermined angular interval about said driving shaft, a first means for controlling the angular position of said frame, a valve-lifting crankshaft supported by said frame, a second gear wheel attached to said valve-lifting crankshaft and engaged with said first gearwheel, a rocker cam assembly including a plurality of cams with each of said cams having at least one lobe, a connecting rod pivotally connected to said valve-lifting crankshaft and said rocker cam assembly, a plurality of cam followers wherein each of said cam followers operatively contacts said at least one lobe of said cams, a plurality of charge exchange valves wherein each of said charge exchange valves is connected to at least one of said cam followers, wherein each of said cam followers is operable to actuate one of said charge exchange valves, a plurality of second means for urging each of said cam followers against said at least one lobe of each of said plurality of cams, whereby stroke, lifting duration, and phase of said charge exchange valves are controlled by the angular position of said frame.

11. The apparatus of claim 10, wherein said first means for controlling the angular position of said frame is further defined as a servo mechanism, wherein said servo mechanism comprises:

a motor operatively connected to said frame, a sensor device configured to detect the angular position of said frame, a control device for controlling said motor in response to feedback from said sensor device.

12. The apparatus of claim 10, wherein said plurality of second means for urging each of said cam followers against said at least one lobe of each of said plurality of cams is further defined as a plurality of steel springs.

13. The apparatus of claim 10, wherein said first clear wheel defines a first elliptical shape and rotates about a first elliptical focus and said second clear wheel defines a second elliptical shape and rotates about a second elliptical focus spaced from said first elliptical focus.

14. The apparatus of claim 10, wherein said plurality of cam followers is further defined as a plurality of tappets.

15. The apparatus of claim 10, wherein said plurality of cam followers is further defined as a plurality of finger followers, wherein each of said finger followers includes at least one hydraulic pivot element for supporting said plurality of finger followers and providing valve lash adjustment.

16. The apparatus of claim 10, wherein said valve-lifting crankshaft includes an eccentric for pivotally supporting said connecting rod.

17. The apparatus of claim 10, further including:

a moveable support and a valve lash adjuster operatively connected to said moveable support, wherein said rocker cam assembly is supported by said movable support, and the position of said rocker cam assembly is adjusted by said valve lash adjuster.

18. The apparatus of claim 17, wherein said moveable support comprises a lever pivotally coupled to a fixed support and having a fulcrum defined by said fixed support wherein the angular position of said lever is adjusted by said valve lash adjuster.

* * * * *